US005469602A

United States Patent [19]

Lin

[11] Patent Number: 5,469,602

[45] Date of Patent: Nov. 28, 1995

[54] COLLAPSIBLE HANDLE OF BAGGAGE

[75] Inventor: Ming-Teng Lin, Taichung Hsien, Taiwan

[73] Assignee: Gallant Industries Co., Ltd., Taichung Hsien, Taiwan

[21] Appl. No.: 284,987

[22] Filed: Aug. 4, 1994

[51] Int. Cl.[6] ..... B25G 1/04

[52] U.S. Cl. ..... 16/115

[58] Field of Search ..... 16/115, 111 R, 16/DIG. 38; 280/47.315, 47.371, 655, 655.1; 190/14, 15 R, 104, 18 R, 18 A

[56] References Cited

U.S. PATENT DOCUMENTS

| | | | |
|---|---|---|---|
| 652,096 | 6/1900 | Dunn | 16/115 |
| 1,472,508 | 10/1923 | Beckman | 16/115 |
| 2,298,140 | 10/1942 | Mace | 16/115 |
| 2,595,597 | 5/1952 | Morseth | 16/115 |
| 4,524,484 | 6/1985 | Graham | 16/115 |
| 4,995,487 | 2/1991 | Plath | 190/18 A |
| 5,291,976 | 3/1994 | Ku | 190/18 A |
| 5,335,759 | 8/1994 | Yeh | 190/18 A |

FOREIGN PATENT DOCUMENTS

| | | |
|---|---|---|
| 81216373 | 12/1992 | Taiwan . |
| 82201860 | 2/1993 | Taiwan . |
| 82208435 | 6/1993 | Taiwan . |
| 82209971 | 7/1993 | Taiwan . |
| 82213571 | 9/1993 | Taiwan . |
| 82213603 | 9/1993 | Taiwan . |
| 82214366 | 10/1993 | Taiwan . |
| 83200611 | 1/1994 | Taiwan . |

*Primary Examiner*—P. Austin Bradley
*Assistant Examiner*—Chuck Y. Mah
*Attorney, Agent, or Firm*—Browdy and Neimark

[57] ABSTRACT

A collapsible handle of baggage comprises two outer tubes, one handle, two insertion members, and two retaining members. The two outer tubes are fastened in a parallel manner to the baggage. The handle is provided with a grip portion and two bar portions which extend in a parallel manner from both ends of the grip portion to be inserted into the two outer tubes. The two insertion members are tubular in shape and fastened to the top ends of the two outer tubes such that the bottoms of the two insertion members are contiguous to the projections of the inner walls of the two outer tubes. The two retaining members are provided respectively with a round bottom for fastening to the bottom of the bar portion and for being disposed in the outer tube. The round bottom is provided peripherally with a tubular portion having a predetermined number of slits and at least two elastic arm portions. Each of the arm portions is provided at the top end thereof with a protuberance engageable with the projection of the outer tube so as to permit the handle to be retained and located by the outer tube at the time when the handle is pulled.

6 Claims, 2 Drawing Sheets

COLLAPSICLE HANDLE OF BAGGAGE

FIELD OF THE INVENTION

The present invention relates generally to a baggage, and more particularly to a collapsible handle of baggage.

BACKGROUND OF THE INVENTION

As disclosed in the U.S. Pat. No. 4995487, a baggage and a baggage support member having castors comprise an outer tube provided at the top thereof with an insertion member in which the handle bar is received concentrically. The handle bar is provided at the bottom thereof with an eccentric member capable of creating a friction between the handle bar and the insertion member for locating the handle.

The Taiwanese Patent Serial Nos. 81216373, 82208435, 82209971, 82213571, 83200611, and 82214366 disclose respectively a collapsible handle of baggage, which comprises an outer tube provided with a retaining hole engageable with a retaining member of a handle bar. The baggage handle is therefore retained securely in place with the outer tube.

Another Taiwanese Patent Serial No. 82213603 and the U.S. Pat. No. 5291976 disclose a concealed handle of baggage, which comprises an outer tube provided at the top thereof with a locating socket which is provided in the bottom thereof with a slanted inner wall. The handle bar is put through the locating socket to be received in the outer tube such that the end of the handle bar is connected with a stopping rod section having thereon an obliquely tapered portion having a curvature capable of cooperating with the curvature of the inner wall of the locating socket. As a result, when the handle bar is pulled outwards, the stopping rod section is acted on by the pulling force so as to be retained and located securely by the locating socket.

There is still another Taiwanese Patent Serial No. 82201860 in which a collapsing control member of a baggage handle is disclosed. The baggage handle comprises a handle bar provided at the end thereof with an elastic ring member which can be forced to deform in an outer tube so as to ensure that the collapsible handle is held securely in place while it is located at any position.

SUMMARY OF THE INVENTION

It is primary objective of the present invention to provide an improved collapsible handle of baggage.

The foregoing objective of the present invention is attained by a collapsible handle of baggage, which comprises two outer tubes, a handle, two insertion members, and two retaining members. The two outer tubes are fastened in a parallel manner to the baggage. The handle is provided with a grip portion and two bar portions which extend in a parallel manner from both ends of the grip portion to be inserted into the two outer tubes. The two insertion members are tubular in shape and fastened to the top ends of the two outer tubes such that the bottoms of the two insertion members are contiguous to the projections of the inner walls of the two outer tubes. The two retaining members are provided respectively with a round bottom for fastening to the bottom of the bar portion and for being disposed in the outer tube. The round bottom is provided peripherally with a tubular portion having a predetermined number of slits and at least two elastic arm portions. Each of the arm portion is provided at the top end thereof with a protuberance engageable with the projection of the outer tube so as to permit the handle to be retained and located by the outer tube at the time when the handle is pulled.

DETAILED DESCRIPTION OF THE INVENTION

Figure 2:
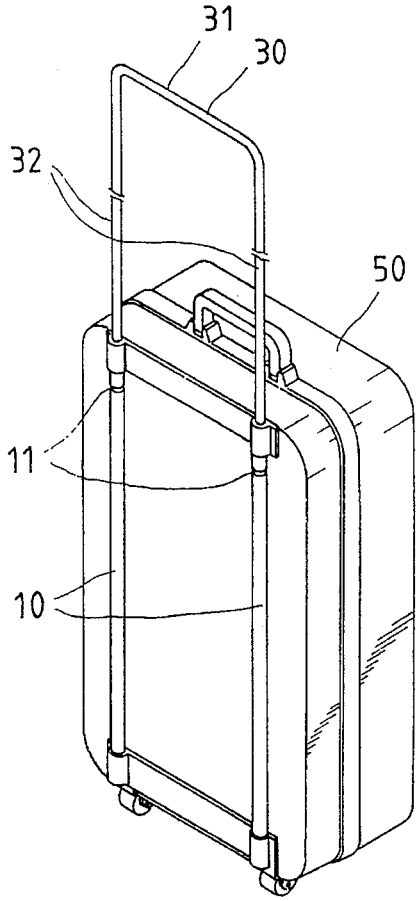
FIG. 2 shows a perspective view of a baggage with the first preferred embodiment of the present invention attached thereto.
Figure 1:
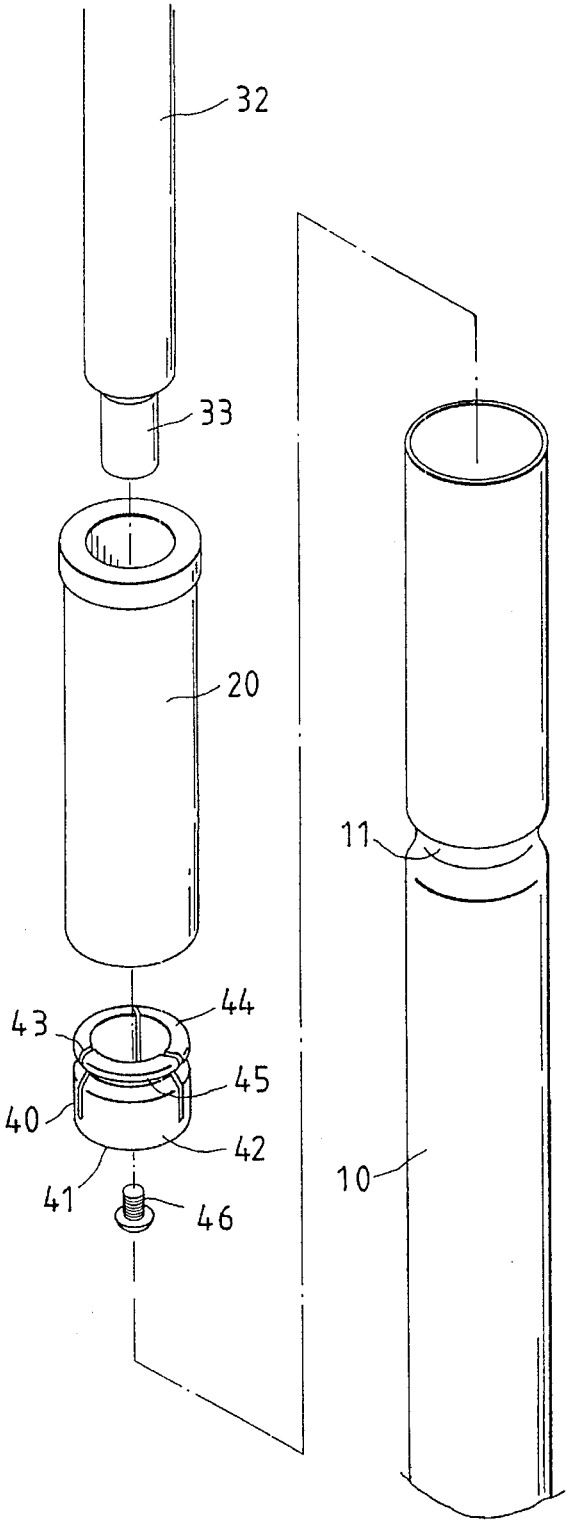
FIG. 1 shows an exploded view of a first preferred embodiment of the present invention.

As shown in FIGS. 1–4, a collapsible handle of baggage of the first preferred embodiment of the present invention comprises the component parts, which are described explicitly hereinafter.

Two outer tubes 10 are fastened in a parallel manner to the back of a baggage 50. The two outer tubes 10 are provided respectively with a circular slot 11 for forming a circular projection 12 on the inner wall of the outer tube 10.

Two insertion members 20 of a round tubular construction are fastened respectively to the top end of the outer tube 10 such that the bottom of the insertion member 20 is contiguous to the projection 12 of the inner wall of the outer tube 10.

A handle 30 has a grip portion 31 and two bar portions 32 extending in a parallel manner from both ends of the grip portions 31. Each of the two bar portions 32 can be inserted into the insertion member 20 such that the bar portion 32 is received in the outer tube 10. The bar portions 32 are provided respectively with an end portion 33 having a smaller outer diameter.

Two retaining members 40 are provided respectively with a round bottom 41 which has a tubular portion 42 extending upwards from the periphery thereof. The tubular portion 42 is provided with a predetermined number of slits 43 extending downwards from the top thereof. In the first preferred embodiment of the present invention, there are three slits 43. As a result, the tubular portion 42 has three arm portions 44, each of which is provided on the outer wall of the top end thereof with a protuberance 45. The two retaining members 40 are fastened respectively at the round bottom 41 thereof with both end portions 33 of the handle 30 by means of a locking member 46 and are received respectively in the outer tubes 10. The protuberance 45 can be retained by the projection 12 of the inner wall of the outer tube 10 so that the handle 30 can be retained and located after the handle 30 is pulled.

Each of the two insertion members 20 is capable of guiding stably the handle 30 to move up and down in the outer tubes 10. The bottom of each of the two insertion members 20 serves to stop the retaining member 40 so as to prevent the retaining member 40 from moving beyond its retaining position at the time when the handle 30 is pulled out forcibly.

Figure 5:
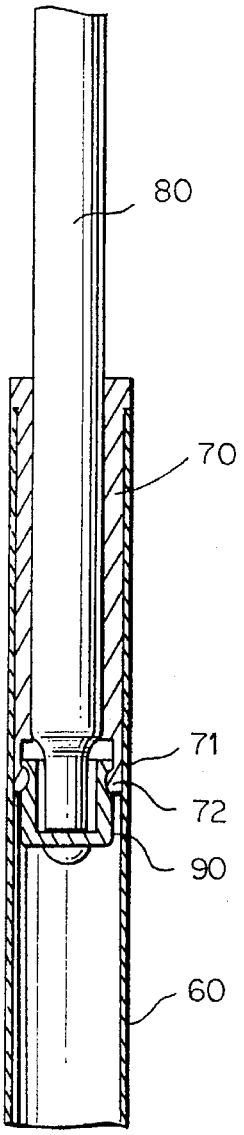
FIG. 5 shows a schematic view of the structure of a second preferred embodiment of the present invention.
Figure 4:
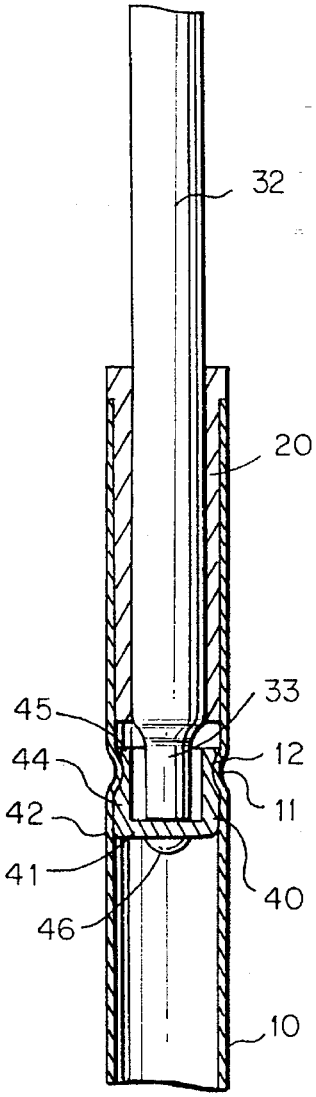
FIG. 4 is a schematic view showing that the handle of the first preferred embodiment of the present invention is pulled upwards to be located.
Figure 3:
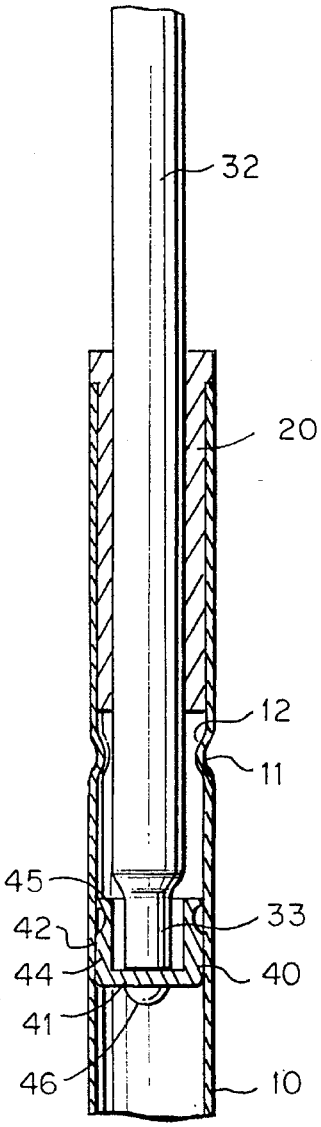
FIG. 3 is a schematic view showing that the handle of the first preferred embodiment of the present invention is not pulled upwards.

As shown in FIG. 5, the second preferred embodiment of the present invention is similar in construction to the first preferred embodiment of the present invention and is composed of two outer tubes 60, two insertion members 70, one handle 80, and two retaining members 90. The second preferred embodiment is different from the first preferred embodiment in that the two outer tubers 60 of the second preferred embodiment are devoid of a circular slot, and that the two insertion members 70 are provided respectively at the bottom thereof with a thin circular portion 71 which has a protruded portion 72 located on the inner wall of the bottom thereof. The protruded portion 72 can be retained by the retaining member 90.

What is claimed is:

1. A collapsible handle of baggage comprising:

two outer tubes fastened in a parallel manner to a baggage; and a handle having a grip portion and two bar portions which extend in a parallel manner from both ends of said grip portion and which can be inserted into said two outer tubes;

wherein said two outer tubes have respectively an inner wall provided with a circular projection;

wherein said two bar portions are provided respectively at a bottom thereof with a retaining member having a round bottom and a tubular body which extends upwards from a periphery of said retaining member, said tubular body provided with a predetermined number of slits extending downwards from a top thereof, said tubular body further provided with at least two or more elastic arm portions, each of which is provided on an outer wall of a top thereof with a protuberance engageable securely with said projection of said outer tube.

2. The collapsible handle of baggage according to claim 1 wherein said outer tubes are provided respectively with an insertion member which is tubular in construction and has an axial hole dimensioned to receive therein said bar portion of said handle.

3. The collapsible handle of baggage according to claim 2 wherein said circular projection comprises a thin circular portion extending downwards from a bottom of said insertion member and having a protruded portion located on an inner wall of said bottom.

4. The collapsible handle of baggage according to claim 1 wherein said circular projection comprises a circular slot formed in the outer tube for forming on an inner wall of said outer tube a projection engageable with said retaining member.

5. The collapsible handle of baggage according to claim 4 wherein said two outer tubes are provided respectively with an insertion member of a tubular construction and having an axial hole dimensioned to receive therein said bar portion, said insertion member further having a bottom separated by a predetermined interval from said projection of said outer tube, said bottom of said insertion member serving as a stopping point of an up-and-down movement of said retaining member in said outer tube.

6. The collapsible handle of baggage according to claim 1 wherein said retaining members are provided respectively with three or four arm portions.

* * * * *